US012196488B2

(12) United States Patent
Golubev et al.

(10) Patent No.: US 12,196,488 B2
(45) Date of Patent: Jan. 14, 2025

(54) METHOD FOR OBTAINING ONE OR MORE AIR PRODUCTS, AND AIR SEPARATION UNIT

(71) Applicant: Linde GmbH, Pullach (DE)

(72) Inventors: Dimitri Golubev, Geretsried (DE); Daniel Palaniswamy Otte, Königsbrunn (DE)

(73) Assignee: Linde GmbH, Pullach (DE)

( * ) Notice: Subject to any disclaimer, the term of this patent is extended or adjusted under 35 U.S.C. 154(b) by 938 days.

(21) Appl. No.: 17/287,830

(22) PCT Filed: Oct. 9, 2019

(86) PCT No.: PCT/EP2019/025336

§ 371 (c)(1),
(2) Date: Apr. 22, 2021

(87) PCT Pub. No.: WO2020/083520

PCT Pub. Date: Apr. 30, 2020

(65) Prior Publication Data

US 2021/0381762 A1 Dec. 9, 2021

(30) Foreign Application Priority Data

Oct. 26, 2018 (EP) ..... 18020559

(51) Int. Cl.
*F25J 3/04* (2006.01)

(52) U.S. Cl.
CPC ..... *F25J 3/04406* (2013.01); *F25J 3/04054* (2013.01); *F25J 3/04187* (2013.01);
(Continued)

(58) Field of Classification Search
CPC .. F25J 3/04406; F25J 3/04054; F25J 3/04187; F25J 3/04284; F25J 3/04721;
(Continued)

(56) References Cited

U.S. PATENT DOCUMENTS 5,475,980 A 12/1995 Grenier et al.
5,802,873 A 9/1998 Howard
(Continued)

FOREIGN PATENT DOCUMENTS

EP 1055894 A1 11/2000
EP 2520886 A1 11/2012
(Continued)

OTHER PUBLICATIONS

H.-W. Häring, "Industrial Gases Processing", Wiley-VCH, 2006, in particular section 2.2.5, "Cryogenic Rectification."
(Continued)

*Primary Examiner* — Jenna M Maroney
*Assistant Examiner* — Ibrahim A. Michael Adeniji
(74) *Attorney, Agent, or Firm* — Millen, White, Zelano & Branigan; Brion P. Heaney

(57) ABSTRACT

A method for obtaining one or more air products by means of an air separation unit comprising a first booster, a second booster, a first decompression machine, and a rectification column system which has a high-pressure column operated at a first pressure level and a low-pressure column operated at a second pressure level below the first pressure level. All of the air supplied to the rectification column system is first compressed to a third pressure level, which lies at least 3 bar above the first pressure level, as a feed air quantity. A first fraction of the feed air quantity is supplied to a first booster at the third pressure level and at a temperature level of −140 to −70° C. and is compressed to a fourth pressure level using the first booster.

14 Claims, 3 Drawing Sheets

(52) U.S. Cl.
CPC ..... *F25J 3/04284* (2013.01); *F25J 3/04721* (2013.01); *F25J 2200/20* (2013.01); *F25J 2205/04* (2013.01); *F25J 2240/40* (2013.01)

(58) Field of Classification Search
CPC .. F25J 2200/20; F25J 2205/04; F25J 2240/40; F25J 3/04024; F25J 3/04175; F25J 3/04381; F25J 2215/54; F25J 2240/44; F25J 2240/46; F25J 3/04084; F25J 3/0409; F25J 3/042; F25J 3/04296; F25J 3/04303; F25J 3/04393; F25J 3/04412; F25J 3/04678; F25J 3/04727; F25J 2230/08
USPC ..... 62/644, 646, 647
See application file for complete search history.

(56) References Cited

U.S. PATENT DOCUMENTS

| | | | | |
|---|---|---|---|---|
| 2005/0126221 | A1* | 6/2005 | Ha | F25J 3/04084 62/646 |
| 2006/0010912 | A1* | 1/2006 | Brugerolle | F25J 3/04187 62/643 |
| 2006/0277944 | A1 | 12/2006 | Le Bot et al. | |
| 2007/0017251 | A1* | 1/2007 | Bot | F25J 3/04175 62/646 |
| 2007/0209389 | A1 | 9/2007 | Prosser | |
| 2013/0255313 | A1* | 10/2013 | Ha | F25J 3/04296 62/643 |
| 2017/0131028 | A1* | 5/2017 | Goloubev | F25J 3/04345 |

FOREIGN PATENT DOCUMENTS

| | | | |
|---|---|---|---|
| EP | 2963367 | A1 | 1/2016 |
| EP | 2980514 | A1 | 2/2016 |
| WO | 2015082860 | A2 | 6/2015 |

OTHER PUBLICATIONS

Castle, W.F., "Modern Liquid Pump Oxygen Plants: Equipment and Performance," AIChE Symposium Series, vol. 89, No. 294.
CRC Press, 2006, in particular sections 2.4, "Contemporary Liquefaction Cycles," 2.6, "Theoretical Analysis of the Claude Cycle," and 3.8.1. "The Lachmann Principle."

* cited by examiner

METHOD FOR OBTAINING ONE OR MORE AIR PRODUCTS, AND AIR SEPARATION UNIT

The invention relates to a method for obtaining one or more air products and to an air separation unit according to the preambles of the independent claims.

PRIOR ART

The production of air products in the liquid or gaseous state by low-temperature separation of air in air separation units is known and is described, for example, in H.-W. Häring (editor), Industrial Gases Processing, Wiley-VCH, 2006, in particular section 2.2.5, "Cryogenic Rectification."

Air separation units have rectification column systems which, for example, can be designed as two-column systems, in particular as classical Linde double-column systems, but also as three-column or multi-column systems. In addition to the rectification columns for obtaining nitrogen and/or oxygen in a liquid and/or gaseous state, i.e., the rectification columns for nitrogen-oxygen separation, rectification columns may be provided for obtaining further air components, in particular the noble gases krypton, xenon, and/or argon.

The rectification columns of the mentioned rectification column systems are operated at different pressure levels. Double-column systems have what is known as a high-pressure column (also referred to as a pressure column, medium-pressure column, or lower column) and what is known as a low-pressure column (also referred to as an upper column). The pressure level of the high-pressure column is, for example, 4 to 6 bar, preferably approximately 5 bar. The low-pressure column is operated at a pressure level of, for example, 1.3 to 1.7 bar, in particular approximately 1.5 bar. The pressure levels indicated here and in the following are absolute pressures present at the head of the mentioned columns.

What are known as main (air) compressor/booster air compressor (MAC/BAC) methods or what are known as high air pressure (HAP) methods may be used for air separation. The main air compressor/booster air compressor methods are the more conventional methods; high air pressure methods are increasingly used as alternatives in more recent times.

Main air compressors/booster air compressors are characterized in that only a portion of the total feed air quantity that is supplied to the rectification column system is compressed to a pressure level which is substantially above the pressure level of the high-pressure column, i.e., by at least 3, 4, 5, 6, 7, 8, 9, or 10 bar. Another portion of the feed air quantity is compressed only to the pressure level of the high-pressure column, or to a pressure level which differs by no more than 1 to 2 bar from the pressure level of the high-pressure column, and is fed into the high-pressure column at this lower pressure level. An example of a main air compressor/booster air compressor method is shown in Häring (see above) in FIG. 2.3A.

In a high air pressure method, on the other hand, the entire feed air quantity that is supplied in total to the rectification column system is compressed to a pressure level which is substantially, i.e., by 3, 4, 5, 6, 7, 8, 9, or 10 bar, above the pressure level of the high-pressure column. The pressure difference can be up to 14, 16, 18, or 20 bar, for example. High air pressure methods are known, for example, from EP 2 980 514 A1 and EP 2 963 367 A1.

From U.S. Pat. No. 5,802,873 A and US 2006/0277944 A1, methods are known in which the total feed air quantity supplied to the rectification column system of an air separation unit is further compressed, after compression in a main air compressor, by means of boosters driven by decompression turbines. A portion of the air previously compressed and in the boosters and subsequently partially cooled is decompressed in the decompression turbines.

In EP 1 055 894 A1, an air separation unit is disclosed in which liquefied natural gas is used as a coolant. In Castle, W. F., "Modern Liquid Pump Oxygen Plants: Equipment and Performance," AIChE Symposium Series, vol. 89, no. 294, measures for removing or preventing the enrichment of hydrocarbons in air separation units are discussed among other things.

The present invention is used in particular given air separation units with what is known as internal compression (IC). At least one product that is provided by means of the air separation unit is hereby formed in that a cryogenic liquid is extracted from the rectification column system, subjected to a pressure increase, and converted into the gaseous or supercritical state by heating. For example, internally compressed gaseous oxygen (GOX IC) or nitrogen (GAN IC) can be generated in this way. The internal compression offers a range of advantages over an alternative, likewise possible external compression and is explained, for example, in Häring (see above), section 2.2.5.2, "Internal Compression." A plant for low-temperature air separation in which an internal compression is used is also disclosed in US 2007/0209389 A1, for example.

Due to markedly lower costs and comparable efficiency, high air pressure methods may represent an advantageous alternative to the more conventional main air compressor/booster air compressor methods. However, as explained in detail below, this does not apply in all cases. In particular, under certain conditions, a poorer energy efficiency results. The present invention is therefore based upon the object of enabling an advantageous use of a high air pressure method at least in a portion of such cases.

DISCLOSURE OF THE INVENTION

This object is achieved by a method for obtaining one or more air products, and by an air separation unit having the features of the independent claims. Embodiments are respectively the subject matter of the dependent claims and of the description below.

In the following, a few principles of the present invention are first explained and terms used to describe the invention are defined.

In the context of this application, a "feed air quantity", or "feed air" for short, is understood to mean the total air supplied to the rectification column system of an air separation unit, and thus all air supplied to the rectification column system. As already explained above, a corresponding feed air quantity in a main air compressor/booster air compressor method is compressed only partially to a pressure level which is markedly above the pressure level of the high-pressure column. By contrast, in a high air pressure method, the entire feed air quantity is compressed to such a high pressure level. Reference is made to the above explanations for the meaning of the term "markedly" in conjunction with main air compressor/booster air compressor and high air pressure methods.

A "cryogenic" liquid is understood here to mean a liquid medium whose boiling point is markedly below the ambient temperature, for example at −50° C. or below, in particular at −100° C. or below. Examples of cryogenic liquids are liquid air, liquid oxygen, liquid nitrogen, liquid argon, or liquids rich in said compounds.

Regarding the devices or apparatuses used in air separation units, reference is made to specialist literature, such as Häring (see above), in particular section 2.2.5.6, "Apparatus." Hereinafter, some aspects of corresponding devices are explained in more detail for clarity and a clearer delimitation.

Multi-stage turbocompressors, which are referred to here as "main air compressors," or "main compressors" for short, are used in air separation units to compress the feed air quantity. The mechanical construction of turbocompressors is generally known to the person skilled in the art. In a turbocompressor, the compression of the medium to be compressed takes place by means of turbine blades which are arranged on a turbine wheel or directly on a shaft. A turbocompressor forms a structural unit which, however, may have a plurality of compressor stages in a multi-stage turbocompressor. A compressor stage normally comprises a turbine wheel or a corresponding arrangement of turbine blades. All of these compressor stages may be driven by a common shaft. However, it may also be provided that the compressor stages are driven in groups with different shafts, wherein the shafts may also be connected to one another via gearing.

The main air compressor is further characterized in that the entire quantity of air fed into the distillation column system and used for the production of air products, that is to say the entirety of the feed air, is compressed by said main air compressor. Accordingly, a "booster air compressor" may also be provided in which, however, only a portion of the air quantity compressed in the main air compressor is brought to an even higher pressure. This may also be designed a turbocompressor. In order to compress partial air quantities, further turbocompressors are typically provided, also referred to as boosters, that only perform compression to a relatively small extent in comparison to the main air compressor or the booster air compressor. A booster air compressor may also be present in a high air pressure method, but this compressor then compresses a sub-quantity of the air starting from a correspondingly higher pressure level.

Air can also be decompressed at a plurality of locations in air separation units, for which purpose decompression machines in the form of turboexpanders, also referred to herein as "decompression turbines," may also be used, among other things. Turboexpanders may also be coupled to and drive turbocompressors. If one or more turbocompressors are driven without externally supplied energy, i.e., only via one or more turboexpanders, the term "turbine booster" is also used for such an arrangement. In a turbine booster, the turboexpander (the decompression turbine) and the turbocompressor (the booster) are mechanically coupled, wherein the coupling may take place at the same rotational speed (for example via a common shaft) or at different rotational speeds (for example via an interposed transmission).

In typical air separation units, corresponding decompression turbines are present at different points for refrigeration and liquefaction of mass flows. These are in particular what are known as Joule-Thomson turbines, Claude turbines, and Lachmann turbines. In addition to the following explanations, reference is made regarding the function and purpose of corresponding turbines to the technical literature, for example F. G. Kerry, Industrial Gas Handbook: Gas Separation and Purification, CRC Press, 2006, in particular sections 2.4, "Contemporary Liquefaction Cycles," 2.6, "Theoretical Analysis of the Claude Cycle," and 3.8.1. "The Lachmann Principle."

In a Joule-Thomson turbine, a high-pressure air flow is decompressed in an air separation unit. This flow is necessary for evaporating and heating up internally compressed products. In most cases, this compressed air is appreciably supercooled before decompression, or is cooled to a relatively low temperature in the supercritical state, and after decompression is directed into the high-pressure column of a double-column system. The Joule-Thomson turbine thus assumes the role of an expansion valve, by means of which what is known as a throttle flow in the high-pressure column is decompressed in conventional systems. It may also be designed as a liquid turbine, as explained in more detail below.

In the case of a double-column system, cooled compressed air is decompressed from a higher pressure level to the pressure level of the high-pressure column and fed into said high-pressure column by means of a Claude turbine. By contrast, cooled compressed air is decompressed to the pressure level of the low-pressure column and fed into said low-pressure column by means of a Lachmann turbine. A Claude turbine is also referred to as a medium-pressure turbine, and a Lachmann turbine is also referred to as a low-pressure turbine. At higher temperature levels, the compressed air is supplied to the Claude and Lachmann turbines as Joule-Thomson turbines so that no (appreciable) liquefaction occurs during the decompression. In conjunction with air separation units, the two turbines are also referred to as "gas turbines."

Typically, a Joule-Thomson turbine together with either a Claude turbine or a Lachmann turbine are used in air separation units configured for internal compression. If omitting a Joule-Thomson turbine, only a Claude turbine or a Lachmann turbine may also be used. In all cases, the use of corresponding turbines serves to compensate for exergy losses and heat leaks.

In particular, main air compressors/booster air compressor methods benefit from the use of a Joule-Thomson turbine (instead of the conventional expansion valve) to which the throttle flow in the liquid state is supplied at supercritical pressure and is extracted at subcritical pressure, still in the liquid state. Such a turbine is also referred to as a liquid turbine (dense liquid expander or dense fluid expander, DLE). The energetic advantages of such a dense liquid expander are likewise described in the technical literature cited above, for example section 2.2.5.6, "Apparatus," pages 48 and 49.

In the language as used herein, liquid fluids, gaseous fluids, or also fluids present in a supercritical state may be rich or poor in one or more components, wherein "rich" may refer to a content of at least 75%, 90%, 95%, 99%, 99.5%, 99.9%, or 99.99%, and "poor" may refer to a content of at most 25%, 10%, 5%, 1%, 0.1%, or 0.01% on a molar, weight, or volume basis. The term "predominantly" may correspond to the definition of "rich" as was just given, but in particular denotes a content of more than 90%. For example, if "nitrogen" is discussed here, this may refer to a pure gas but also to a gas rich in nitrogen.

In the following, the terms "pressure level" and "temperature level" are used to characterize pressures and temperatures, whereby it should be expressed that pressures and temperatures do not need to be used in the form of exact pressure or temperature values in order to realize an inventive concept. However, such pressures and temperatures typically fall within certain ranges that are, for example, ±1%, 5%, or 10% around an average. Different pressure levels and temperature levels may be in disjoint ranges or in ranges which overlap one another. In particular, pressure levels, for example, include unavoidable or expected pressure losses, for example due to cooling effects. The same applies to temperature levels. The pressure levels indicated here in bar are absolute pressures.

Advantages of the Invention

In air separation methods, or in corresponding units, by means of which at most small quantities of liquid air products are to be provided, and in which certain internal compression pressures are required, a high air pressure method with what is known as a warm booster and optionally what is known as a cold booster, both of which are respectively driven via a decompression turbine with partial feed air quantities, constitutes a cost-effective alternative to main air compressor/booster air compressor methods.

A "warm" booster is understood to mean a booster to which air is supplied, typically at a temperature level markedly above 0° C., for example at ambient or cooling water temperature, or also above this due to compression heat. By contrast, air is supplied to a "cold" booster at a temperature level typically below −50° C., which can be achieved in particular by cooling the air in the main heat exchanger of the air separation unit. Specific temperature levels are discussed below. The air supplied to a warm booster may in principle also be cooled in the main heat exchanger, but only to a comparatively small extent.

However, in some circumstances, the maximum pressure that may be achieved by a series connection of a warm booster and a cold booster is not high enough to optimally balance the hot and cold fluid flows conducted through the main heat exchanger without greatly raising the pressure at the main air compressor or reaching the limits of buildability for corresponding turbine boosters. A corresponding increase in the pressure at the main air compressor leads to an energy penalty as compared with a main air compressor/booster air compressor method.

By means of conventional main air compressor/booster air compressor methods, a relatively good adaptation to different product configurations may take place since both compressors used (main air compressor and booster air compressor) are "responsible" for functionally separate tasks. In principle, the main air compressor supplies only the feed air for the air separation; the booster air compressor supplies energy or cold for internal compression and liquid production. A very good energy efficiency may be achieved via a clever connection of the turbines and the booster air compressor, in particular also via an intermediate extraction, and the use of additional throttle flows. However, a high number of compressor stages is generally necessary for this purpose, which increases the investment costs.

In a high air pressure method, said tasks are fulfilled by only one compressor. Thus, the entire feed air must be compressed to a high pressure in order to achieve a good balance between cold and hot flows in the main heat exchanger. The required high pressure must be provided by the turbine booster or turbine boosters and the main air compressor pressure. In some cases, primarily given product configurations having no or very small quantities of liquid, an efficient balancing is, as already mentioned, difficult to realize without jeopardizing the buildability of the turbine boosters or, as mentioned, very greatly increasing the main air compressor pressure.

High air pressure methods are known in which it is provided to generate a high-pressure throttle flow using a cold booster upstream of which a warm booster is connected. In this way, the buildability of the turbine booster may be markedly improved and the pressure at the main air compressor may be reduced. Since the warm booster usually needs to compress a comparatively large quantity of air, or the quantity ratios between the decompression turbines driving the boosters and the boosters need to be adjusted in such a way that the corresponding machines can be built, the step pressure ratio, that is to say the pressure ratio between the suction-side and pressure-side pressures at the booster, is typically less than approximately 1.4 in the conventional methods. In a cold booster, a step pressure ratio of up to 2 can be achieved. Nevertheless, the energy efficiency in such a method proves to not be equivalent to a main air compressor/booster air compressor method. For example, a method with two cold boosters connected in series is known from US 2013/0255313 A1. However, such a method is also not advantageous in all cases.

For a fictitious product configuration (13,000 $Nm^3/h$ internally compressed gaseous oxygen at 15 bar) with a conventional high air pressure connection with cold booster, only an energy yield which is inferior by approximately 10% may be achieved as compared to a main air compressor/booster air compressor method (with self-boosted Lachmann turbine, that is to say a Lachmann turbine to which an air flow is supplied which was previously compressed by a booster coupled to the Lachmann turbine). Primarily in the field of what is known as package air separation units (compact structural units with a production output of up to approximately 23,000 $Nm^3/h$ gaseous oxygen), those with pure gas production at a pressure level of approximately 30 bar are requested more and more frequently.

In the preceding comparison, it was assumed that no liquid turbine is used. If a liquid turbine is used, a further increase in energy efficiency may be achieved in particular given main air compressor/booster air compressor methods. Since the performance of a liquid turbine generally depends strongly on the pressure, its use is generally always markedly more advantageous in conventional main air compressor/booster air compressor methods, due to the higher pressures achievable there, than in known high air pressure methods. It is therefore to be assumed that the cited differences will in this case again be exacerbated to the detriment of the high air pressure methods. However, the investment costs increase due to the use of a liquid turbine, which is disadvantageous in particular given small installations.

Due to the measures explained in the following, the present invention enables a marked improvement in the performance or energy efficiency of a high air pressure method (in comparison to a main air compressor/booster air compressor method), which is limited by the buildability of the respective turbine/booster interconnection in the manner as explained. This applies in particular to the case explained above, in which no or only comparatively small quantities of liquid air products are to be provided. Within the scope of the present invention, in particular the main advantage of a high air pressure method (lower investment costs compared to a main air compressor/booster air compressor method) is thereby maintained without impairing the energy efficiency.

The present invention solves the explained problems in that the generation of a high-pressure process air flow, which is required in particular for evaporating the fluid flows used for providing internal compression products, is provided by means of the turbine boosters used in a manner which makes it possible to advantageously increase the respective step pressure ratios at these turbine boosters. For this purpose, within the scope of the present invention, a method is proposed for obtaining one or more air products using an air separation unit comprising a first booster, a second booster, a first decompression machine, and a rectification column system which has a high-pressure column operated at a first pressure level and a low-pressure column operated at a second pressure level below the first pressure level. With respect to the first and second pressure levels, which can correspond in particular to pressure levels customary for high- and low-pressure columns of air separation units, reference is expressly made to the explanations made above and the details below.

In the method proposed according to the invention, the entirety of the air supplied to the rectification column system is first compressed as a feed air quantity, in particular in a main air compressor of the air separation unit, to a third pressure level which is at least 3 bar above the first pressure level. The method proposed according to the invention is thus a typical high air pressure method. Within the scope of the present invention, the third pressure level may in particular be in a range from 10 to 20 bar, for example in a range from 11 to 14 bar.

Within the scope of the present invention, a first fraction of the feed air quantity is supplied at the third pressure level and a temperature level of −140 to −70° C., in particular −135 to −110° C., to a booster which thus represents a cold booster in the sense explained above. This booster is hereinafter referred to as "first" booster. The first fraction of the feed air quantity is further compressed using the first booster to a pressure level that is referred to herein as "fourth" pressure level. In particular, the main heat exchanger of the air separation unit is respectively used for cooling the first fraction of the feed air quantity and for all further cooling and heating processes explained in the following, insofar as these do not result from the decompression or compression themselves.

A second fraction of the feed air quantity, or a sub-quantity of the first feed air quantity, that has been compressed to the fourth pressure level using the first booster is supplied at the third pressure level to a first decompression turbine, which is used to drive the first booster, and in particular may be coupled thereto in the manner explained above. The second fraction of the feed air quantity, or the sub-quantity of the first feed air quantity, that has been compressed to the fourth pressure level using the first booster is decompressed to the first pressure level using this first decompression turbine, that is to say to the pressure level at which the high-pressure column is operated. The first decompression turbine represents a typical Claude turbine.

Within the scope of the present invention, a sub-quantity of the first fraction of the feed air quantity that has been compressed in the first (cold) booster is warmed up in a main heat exchanger of the air separation unit and supplied to a warm booster, which is hereinafter referred to as "second" booster. The mentioned sub-quantity of the second fraction of the feed air quantity is compressed by means of this second booster to an even higher pressure level, which is hereinafter referred to as "fifth" pressure level.

According to the invention, the first fraction of the feed air quantity is extracted from the first booster at a temperature level of −120 to −60° C., and the sub-quantity of the first feed air quantity which is compressed to the fifth pressure level using the second booster is heated to a temperature level of −20 to 40° C., in particular 20 to 30° C., prior to being compressed in the second booster. The measures proposed with these are, in particular, in a higher achievable step pressure ratio, as explained in more detail elsewhere.

Furthermore, within the scope of the present invention, additional air, which, as also explained below, may in particular be a further fraction of the feed air at the third pressure level or an additional sub-quantity of the second fraction of the feed air quantity which has been compressed in the first (cold) booster, may be decompressed in a decompression turbine, hereinafter referred to as "second" decompression turbine. Using the second decompression turbine, said additional air is decompressed to the second pressure level, that is to say the pressure level at which the low-pressure column of the distillation column system that is used in the method is operated. This is thus a typical Lachmann turbine. The second decompression turbine drives the second booster and is in particular coupled thereto in the manner explained above.

Within the scope of the present invention, the first (cold) booster may in particular provide a step pressure ratio of 1.5 to 2.2, for example approximately 1.9. Furthermore, because of the comparatively small quantity of air which is conducted through the second (warm) booster, a step pressure ratio of 1.4 to 2.1, for example approximately 1.8, can be adjusted with a likewise small quantity of air which is decompressed by means of the second decompression turbine (but with a decompression from the high third pressure level of, for example, approximately 12 bar to a comparatively low second pressure level of, for example, approximately 1.4 bar, and associated increased cold production).

The cooling performance to be achieved at the two decompression turbines may thereby be optimally adjusted since the ratio of the flows through the decompression turbines to those through the boosters can be varied well (with respect to the specific rotational speeds of decompression turbine to booster). The performance of the second decompression turbine (Lachmann turbine) may be supplied entirely as cold to the process since it drives a warm booster (this would not be possible in the case of a cold booster since the cold is supplied again to the process as heat of the cold booster).

By using the second decompression turbine, corresponding to a Lachmann turbine, the injection equivalent may be increased and the efficiency of the method may thus be increased overall. Due to the improved step pressure ratios, the third pressure level may be reduced by approximately 1 to 3 bar in contrast to conventional variants, which saves approximately 3% energy in the investigated product configuration. The decrease is possible since the increased step pressure ratios enable a stronger compression of a corresponding air fraction. The investment costs are very similar since the number of apparatuses used is not increased. By warming up the mass flow compressed by the first booster prior to the further compression in the second booster, the main heat exchanger volume is increased (by approximately 10 to 25%). In some circumstances, a compressor stage at the main air compressor may be saved due to the third pressure level turning out to be lower.

The present invention overall enables an improvement of the efficiency of high air pressure interconnections with respect to energy consumption, without needing to accept a loss of cost advantages over main air compressor/booster air compressor interconnections or conventional high air pressure interconnections. The potential energy consumption, in the case considered above, is up to 5% lower than in a conventional high air pressure method with cold booster. Furthermore, by lowering the pressure at the main air compressor, a compressor stage at the main air compressor can be saved, whereby the investment costs are reduced. As compared to a high air pressure method with two cold boosters and one warm booster, a turbine unit is saved, which increases the availability of the unit. Therefore, in the method according to the invention, the first booster advantageously represents the only booster which, in the unit, is supplied with fluid at a temperature level below −50° C., in particular below −100° C. and down to −150° C.

As already mentioned, in the method according to the invention, the additional air which is supplied at the third or at the fourth pressure level to a second decompression turbine which drives the second booster, and is thus decompressed to the second pressure level, may be formed by an additional sub-quantity of the first feed air quantity which had been compressed to the fourth pressure level in the first booster, or by a third fraction of the feed air quantity at the third pressure level. In the example, a further energy savings of approximately 2% may be achieved in the former case. Overall, an energy savings of approximately 5% thereby results.

Within the scope of the method according to the invention, the first pressure level is in particular 5 to 7 bar, the second pressure level is in particular 1.3 to 1.9 bar, the third pressure level is in particular 11 to 15 bar, the fourth pressure level is in particular 18 to 25 bar, and the fifth pressure level is in particular 30 to 40 bar. As mentioned, in particular the third pressure level may be lowered as compared to known methods via the use of the present invention.

Within the scope of the present invention, the second fraction of the feed air quantity may be supplied to the first decompression turbine, in particular at a temperature level of −160 to −130° C. The same also applies if a sub-quantity of the first feed air quantity which has been compressed to the fourth pressure level using the first booster is supplied to this first decompression turbine. The first and the second fraction of the feed air quantity may also be supplied jointly to a main heat exchanger of the air separation unit and be extracted at the respective different temperature levels. However, a completely separate routing of the first and second fraction of the feed air quantity through the main heat exchanger is also possible.

In particular, the additional air that is supplied to the second decompression turbine, which drives the second booster, may be brought to a temperature level of −90 to −10° C., in particular −60 to −30° C., before it is supplied to the second decompression turbine. If this is the mentioned additional sub-quantity of the first feed air quantity which has been compressed to the fourth pressure level in the first booster and which is present in the colder state, this additional air is correspondingly warmed. By contrast, if the mentioned third fraction of the feed air quantity is at the third pressure level, which is naturally at a higher pressure level, a corresponding cooling takes place.

The air which has been decompressed using the second decompression turbine may be supplied to the main heat exchanger and be cooled to a temperature level of −180 to −140° C., in particular −170 to −150° C., before it is supplied to the low-pressure column at the second pressure level.

Furthermore, within the scope of the present invention, an additional sub-quantity of the first feed air quantity, which has been compressed to the fourth pressure level in the first booster, may be cooled to a temperature level of −175 to −155° C. and then be partially or completely fed into the high-pressure column.

The second fraction of the feed air quantity, which has been decompressed to the first pressure level in the first decompression turbine, is in particular partially liquefied by the decompression, wherein after a phase separation, a non-liquefied fraction thereof may be partially or completely fed into the high-pressure column, and a non-liquefied fraction may be partially or completely fed into the low-pressure column.

In the method according to the invention, it is advantageously provided that the sub-quantity of the feed air quantity which has been compressed to the fifth pressure level in the second booster is then cooled to a temperature level of −175 to −155° C. and fed into the high-pressure column.

The additional air which has been expanded to the second pressure level in the second decompression turbine and which can be provided as explained above may, in particular, be fed into the low-pressure column after this decompression, as is known inasmuch with regard to Lachmann turbines.

Within the scope of the present invention, the first decompression turbine may also be coupled to a braking device so that larger air quantities may be decompressed therein than would be possible given only a coupling to the first booster. Additional cold may be generated in this way.

In the method according to the invention, one or more liquid mass flows is or are advantageously extracted from the distillation column system, pressurized in the liquid state, thereafter evaporated or transformed into the supercritical state, and discharged from the air separation unit as one or more compressed products. Within the scope of the present invention, an internal compression is thus performed in particular. The present invention is in particular suitable for internal compression methods in which pressures of less than 25 bar are used, relative to the respectively produced compressed products.

The present invention also extends to an air separation unit for obtaining one or more air products; regarding its features, reference is made to the corresponding independent claim.

Regarding features and advantages of the air separation unit proposed according to the invention, reference is expressly made to the above explanations regarding the method proposed according to the invention. This also applies to an air separation unit according to a particularly preferred embodiment of the present invention, which is configured to implement a method as described in detail above and has appropriate means for this purpose.

The invention is described in more detail below with reference to the accompanying drawings, which illustrate preferred embodiments of the present invention.

In the figures, elements corresponding to one another are indicated by identical reference signs and are not explained repeatedly for the sake of clarity.

DETAILED DESCRIPTION OF THE DRAWINGS

Figure 1:
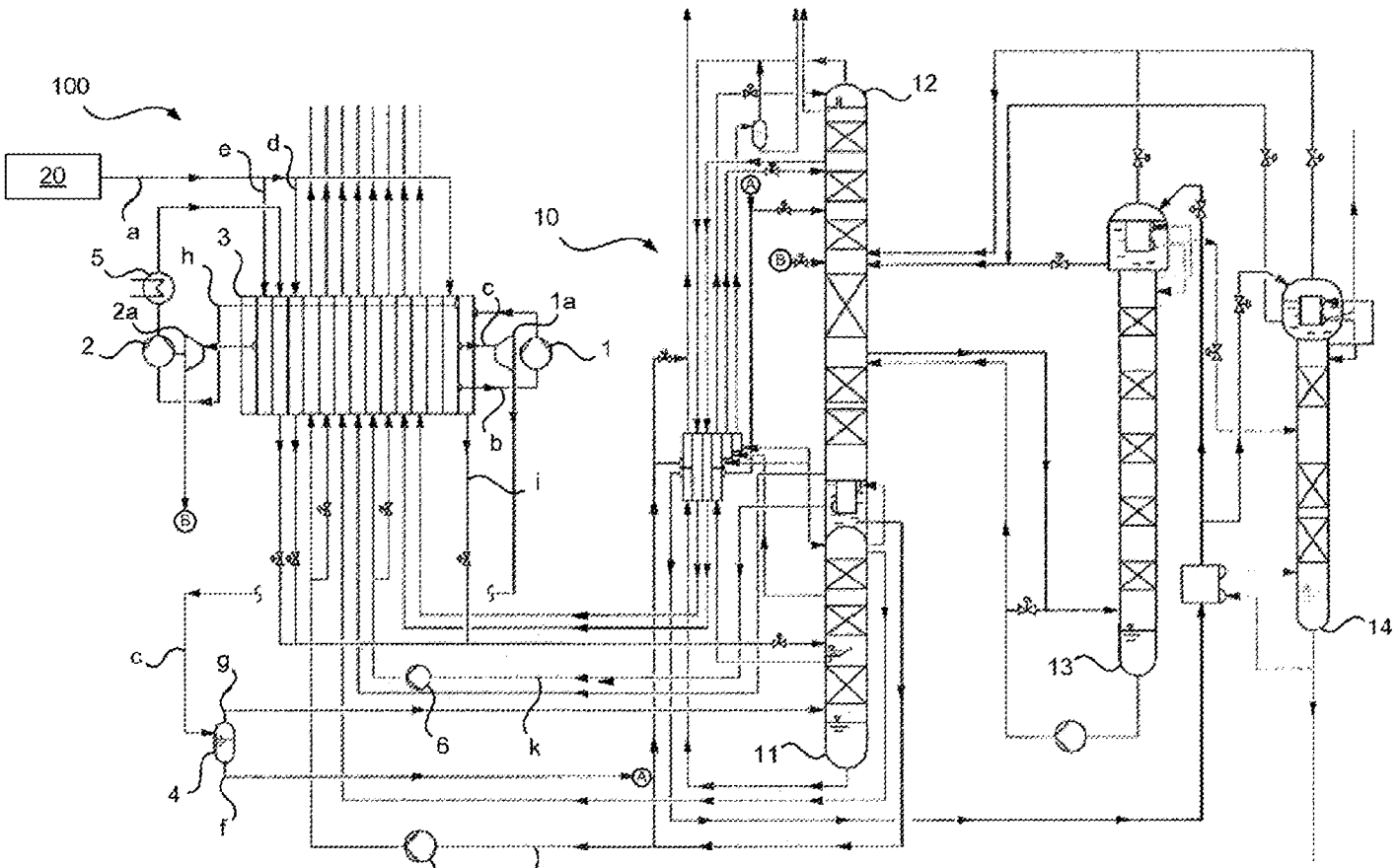
FIG. 1 shows an air separation unit according to an embodiment of the invention in a simplified schematic representation.

In FIG. 1, an air separation unit according to an embodiment of the invention is shown in a greatly simplified schematic representation and designated as a whole as 100. For a more detailed explanation of unit parts not shown in FIG. 1, reference is made to the technical literature, such as Häring (see above), for example.

In the air separation unit 100, a compressed, purified, and pre-cooled feed air flow a is provided in what is known as a warm part 20 via devices not individually illustrated here. For example, in the warm part 20 for providing the feed air flow a, atmospheric air may be drawn in across a filter by means of a main air compressor, which in particular may be designed in multiple stages and to which one or more aftercoolers may be connected downstream, and be compressed to a pressure level referred to herein as "third" pressure level. The air may subsequently be cooled and in particular purified by means of adsorbers.

The air separation method carried out in the air separation unit 100 is a high air pressure method explained above so that the third pressure level is at least 3 bar above a pressure level at which a high-pressure column 11 of a rectification column system 10 is operated and which is referred to herein as "first" pressure level. The rectification column system 10 furthermore comprises a low-pressure column 12 operated at a pressure level below the first pressure level, referred to herein as "second" pressure level.

The rectification column system 10 moreover has a crude argon column 13 and a pure argon column 14, which are not explained in greater detail here for reasons of clarity. Reference is again made to the technical literature, in particular FIG. 2.3A in Häring (see above) and there also to pages 26 ff., "Rectification in the Low-pressure, Crude and Pure Argon Column," as well as pages 29 ff., "Cryogenic Production of Pure Argon."

The total air quantity supplied to the rectification column system 10, which is compressed to the third pressure level, is referred to herein as "feed air quantity." In the shown example, this feed air quantity is divided, upstream and inside a main heat exchanger 3 of the air separation unit 100, into a total of four mass flows b, c, d, e, wherein the mass flows b and c are initially supplied here to the main heat exchanger 3 in the form of a common mass flow, and the actual formation of the individual mass flows b and c takes place only via the extraction from the main heat exchanger 3 at different temperature levels.

Here, the mass flows b and c are thus supplied jointly to the main heat exchanger 3 of the air separation unit 100 but are extracted therefrom at preferably different intermediate temperature levels. These temperature levels have already been explained above. The mass flow b is subsequently supplied to a further compression in a cold booster 1 (referred to herein as "first" booster) which is coupled to a ("first") decompression turbine 1*a*. This further compression takes place at a pressure level that is referred to herein as "fourth" pressure level. The mass flow c is decompressed in the first decompression turbine 1*a*, and in fact in particular to the first pressure level of the high-pressure column 11. In the shown example, it is partially liquefied by the decompression in the decompression turbine 1*a* and is subsequently fed into a separator 4. A remaining gaseous fraction is fed in the form of a mass flow f into the high-pressure column 11. Liquid from the separator 4 is decompressed in the low-pressure column 12 in the form of a mass flow g (see connection point A).

The mass flow b is supplied again to the main heat exchanger 3 at the fourth pressure level and warmed there to form a first fraction, and is subsequently supplied in the form of a mass flow h to a warm ("second") booster 2 and further compressed there, and in fact to a pressure level which is also referred to herein as "fifth" pressure level. By contrast, a further fraction of the mass flow b is cooled in the main heat exchanger 3 and fed into the high-pressure column 11 in the form of a mass flow i which is combined with the mass flows d and h, which are likewise cooled in the main heat exchanger 3. The partial flow h is cooled in an aftercooler 5 before it is cooled in the main heat exchanger 3. The mass flows d, h, and i are respectively conducted through the main heat exchanger 3 to the cold end.

The mass flow e is cooled down to an intermediate temperature level in the main heat exchanger 3 and is subsequently decompressed in a ("second") decompression turbine 2*a* that is coupled to the second booster 2. This decompression takes place to the second pressure level. The mass flow e is fed (see connection point B) into the low-pressure column 12. The second decompression turbine 2*a* is therefore a typical Lachmann turbine.

The air separation unit 100 is configured for internal compression. In the shown example, for this purpose, nitrogen-rich head gas is extracted from the high-pressure column 11, liquefied in a heat-exchanging manner in a main condenser (not separately designated) which connects the high-pressure column 11 and a low-pressure column 12, and supplied as a liquid in the form of a mass flow k to an internal compression pump 6. After the mass flow k in the internal compression pump 6 has been brought to a higher pressure level, for example to a supercritical pressure level, it is evaporated in the main heat exchanger 3 or transformed from the liquid state into the supercritical state. A corresponding nitrogen-rich air product may be output at the system boundary. A liquid, oxygen-rich air product may be withdrawn from the sump of the low-pressure column 12 in the form of a mass flow I, correspondingly pressurized in an internal compression pump 7, evaporated or transformed into the supercritical state in the main heat exchanger 3, and ultimately be output as an oxygen-rich air product at the system boundary.

The additional mass flows that are shown in FIG. 1 and are in particular conducted through the main heat exchanger 3 may be learned from the cited technical literature. The air separation unit 100 inasmuch works as usual.

Parts of air separation units according to further embodiments of the invention are shown schematically in greatly simplified form in FIGS. 2 to 5. Only the schematically represented warm part 20, the main heat exchanger 3, the first booster 1, the first decompression turbine 1*a*, the second booster 2, the second decompression turbine 2*a*, and the aftercooler 5 are respectively illustrated. The separator 4, the high-pressure column 11, and the low-pressure column 12 are indicated merely to illustrate the further treatment of the mass flows designated in FIG. 1.

Figure 2:
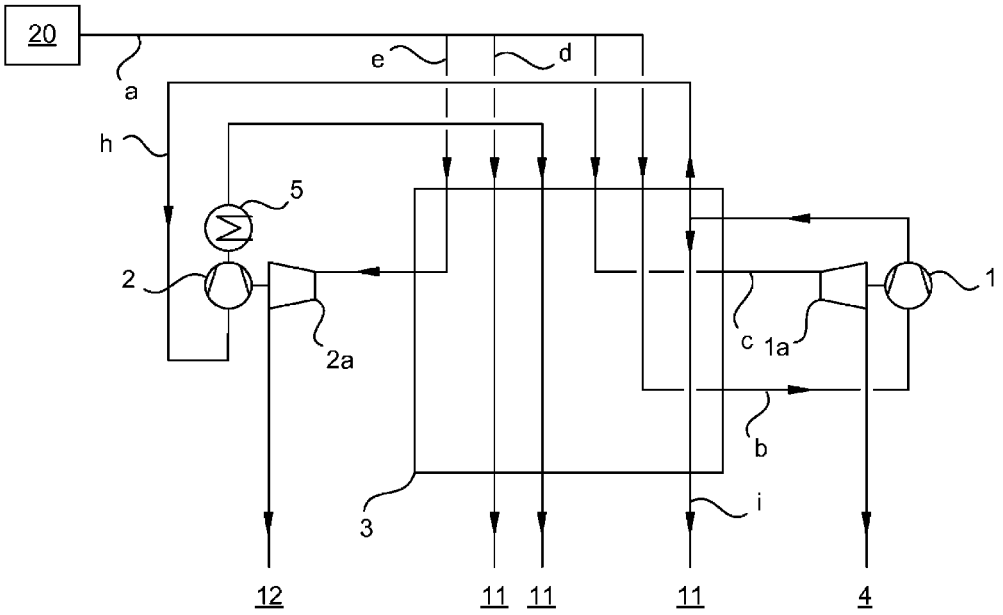
FIG. 2 shows an air separation unit according to another embodiment of the invention in a schematic partial representation.
Figure 3:
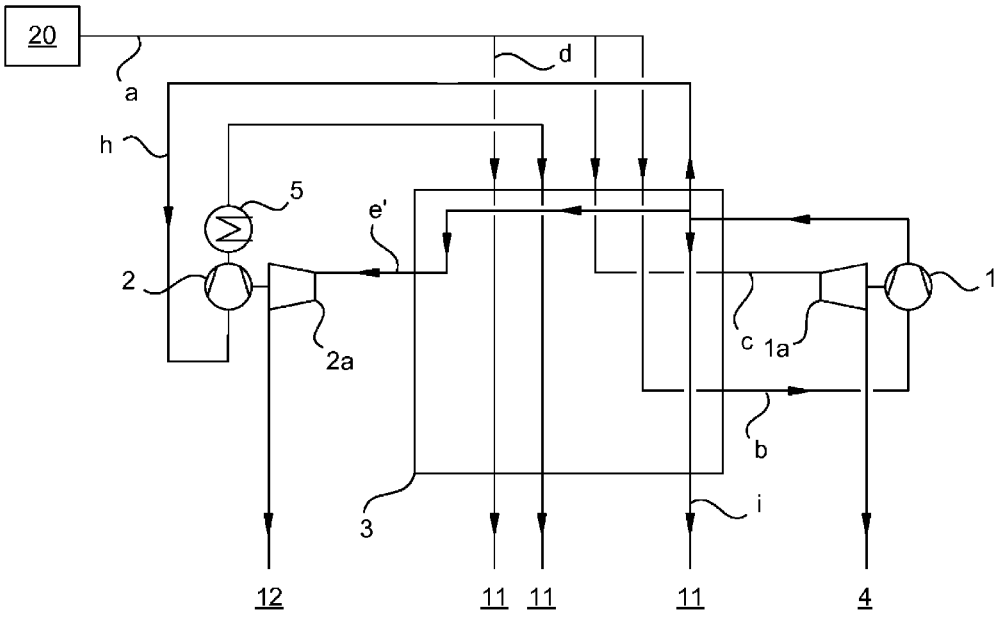
FIG. 3 shows an air separation unit according to another embodiment of the invention in a schematic partial representation.

While the interconnection according to FIG. 2 essentially corresponds to that according to FIG. 1, and only the mass flows b and c are already formed upstream of the main heat exchanger 1, the interconnection according to FIG. 3 differs from those of FIGS. 1 and 2 essentially in that, instead of the mass flow e, a partial flow of the mass flow h is supplied to the second decompression turbine 2*a* here. This partial flow is designated as e' in FIG. 3. The mass flow e' is warmed before the decompression in the second decompression turbine 2*a*, whereas the mass flow e of the previously explained figures is correspondingly cooled.

With respect to the treatment of the mass flow e, the interconnection according to FIG. 4 corresponds again to FIG. 2; however, in this regard, a flow routing according to FIG. 3 may also be provided. The mass flow e that is decompressed in the second decompression turbine 2*a* is here further cooled in the main heat exchanger 3, within the scope explained above, before it is supplied here to the low-pressure column 12.

Figure 4:
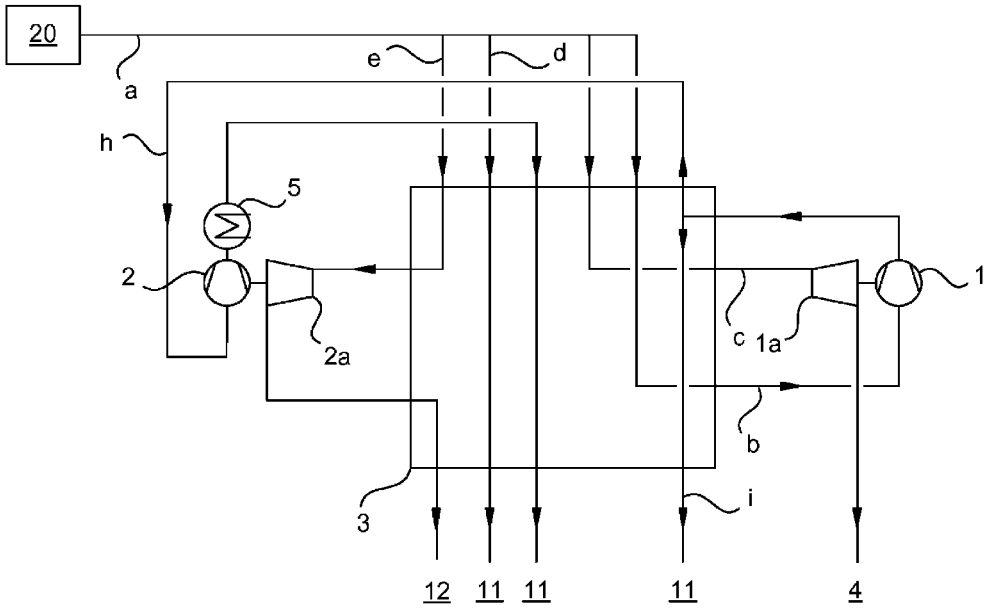
FIG. 4 shows an air separation unit according to another embodiment of the invention in a schematic partial representation.
Figure 5:
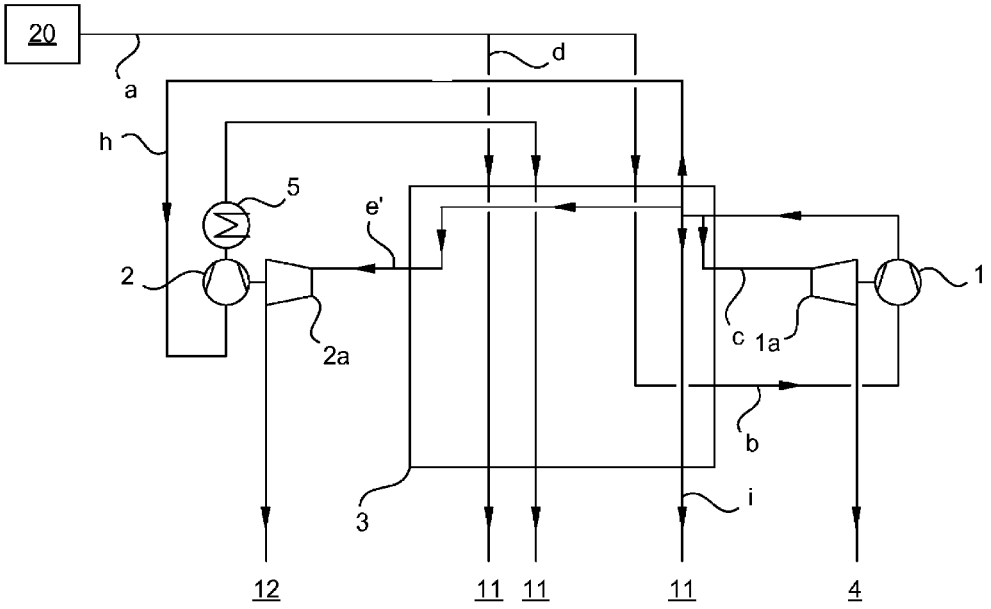
FIG. 5 shows an air separation unit according to another embodiment of the invention in a schematic partial representation.

With respect to the treatment of the mass flow e, the interconnection according to FIG. 5 corresponds again to FIG. 3; however, in this regard, a flow routing according to FIG. 2 or 4 may also be provided. In a deviation from the previous embodiments, a sub-quantity of the first feed air quantity which has been compressed to the fourth pressure level using the first booster (1) is decompressed here in the first decompression turbine 1*a*.

The invention claimed is:

1. A method for obtaining one or more air products in an air separation unit comprising a first booster, a second booster, a first decompression turbine, and a rectification column system which has a high-pressure column-operated at a first pressure level and a low-pressure column operated at a second pressure level below the first pressure level, said method comprising:

supplying a feed air quantity to the air separation unit wherein the feed air quantity is at a third pressure level, which is at least 3 bar above the first pressure level, supplying a first fraction of the feed air quantity to the first booster at the third pressure level and at a temperature level of −140 to −70° C. and compressing the first fraction in the first booster to a fourth pressure level, supplying (a) a second fraction of the feed air quantity and/or (b) a first portion of the first fraction which has been compressed in the first booster to the fourth pressure level to the first decompression turbine, which is used to drive the first booster, and is decompressed in the first decompression turbine to the first pressure level, and supplying a further portion of the first fraction which has been compressed to the fourth pressure level in the first booster to the second booster and is compressed in the second booster to a fifth pressure level, and wherein the first fraction of the feed air quantity is at a temperature level of −120 to −60° C. at the outlet of the first booster, and wherein the further portion of the first fraction which is compressed to the fifth pressure level using the second booster is heated to a temperature level of −20 to 40° C. prior to being compressed in the second booster.

2. The method according to claim 1, further comprising supplying air at the third or at the fourth pressure level to a second decompression turbine, which is used to drive the second booster, and the air supplied to the second decompression turbine is decompressed to the second pressure level in the second decompression turbine, wherein the air supplied to the second decompression turbine is a fraction of the air compressed to the fourth pressure level in the first booster, or is a third fraction of the feed air quantity compressed to the third pressure level.

3. The method according to claim 1, wherein the first pressure level is 5 to 7 bar, the second pressure level is 1.2 to 1.9 bar, the third pressure level is 11 to 15 bar, the fourth pressure level is 18 to 25 bar, and the fifth pressure level is 30 to 40 bar absolute pressure.

4. The method according to claim 1, wherein the second fraction of the feed air quantity and/or the first fraction compressed to the fourth pressure level in the first booster is supplied to the first decompression turbine at a temperature level of −160 to −130° C.

5. The method according to claim 2, wherein the air supplied to the second decompression turbine is brought to a temperature level of −90 to −10° C. before being supplied to the second decompression turbine.

6. The method according to claim 1, wherein an additional portion of the first fraction compressed to the fourth pressure level in the first booster is cooled to a temperature level of −177° C. to −160° C. and then is partially or completely fed into the high-pressure column.

7. The method according to claim 1, wherein the second fraction of the feed air quantity which has been decompressed to the first pressure level in the first decompression turbine is partially liquefied by the decompression and, after a phase separation of the decompressed second fraction of the feed air quantity, a non-liquefied fraction of the decompressed second fraction of the feed air quantity is partially or completely fed into the high-pressure column, and a non-liquefied fraction of the decompressed second fraction of the feed air quantity is partially or completely fed into the low-pressure column.

8. The method according to claim 1, wherein the further portion of the first fraction that has been compressed to the fifth pressure level in the second booster is cooled to a temperature level of −177° C. to −160° C. and fed into the high-pressure column.

9. The method according to claim 2, wherein the air which has been decompressed to the second pressure level in the second decompression turbine is fed into the low-pressure column.

10. The method according to claim 2, wherein the air which has been decompressed to the second pressure level in the second decompression turbine is supplied at the second pressure level to a main heat exchanger of the air separation unit and cooled.

11. The method according to claim 1, wherein one or more liquid mass flows are extracted from the rectification column system, pressurized in the liquid state, thereafter evaporated or transformed into supercritical state, and discharged from the air separation unit as compressed products.

12. The method according to claim 1, wherein the first booster is operated at a step pressure ratio of 1.7 to 2.2, and the second booster is operated at a step pressure ratio of 1.4 to 1.8.

13. An air separation unit for obtaining one or more air products, comprising:

a first booster, a second booster, a first decompression turbine, and a rectification column system which has a high-pressure column that is configured for operation at a first pressure level and a low-pressure column that is configured for operation at a second pressure level below the first pressure level, wherein the air separation unit is configured a line for supplying a feed air quantity at a third pressure level which is at least 3 bar above the first pressure level to the air separation unit, a line for supplying a first fraction of the feed air quantity at the third pressure level and at a temperature level of −140 to −70° C. to the first booster, wherein said first fraction is compressed to a fourth pressure level in the first booster, a line for supplying a second fraction of the feed air quantity or a line for supplying a first portion of the first fraction of the feed air quantity compressed to the fourth pressure level in the first booster to the first decompression turbine, which is used to drive the first booster, and to decompress said second fraction or first portion of the first fraction to the first pressure level using the first decompression turbine, a line for supplying a further portion of the first fraction of the feed air quantity compressed to the fourth pressure level to a second booster which is used to compress said further portion to a fifth pressure level, and wherein that the air separation plant further comprises a main heat exchanger which is configured to provide the first fraction of the feed air quantity to the first booster at a temperature level of −100 to −60° C., and wherein the main heat exchanger of the air separation unit is further configured to heat the further portion of the first feed air quantity to a temperature level of −20 to 40° C. prior to compression of the further portion in the second booster.

14. A method for obtaining one or more air products using the air separation unit according to claim 13, the method comprising:

supplying the feed air quantity compressed to the third pressure level, which is at least 3 bar above the first pressure level, to the air separation unit supplying the first fraction of the feed air quantity to the first booster at the third pressure level and at the temperature level of −140 to −70° C., and compressing the first fraction to the fourth pressure level in the first booster, supplying either (a) the second fraction of the feed air quantity or (b) the first portion of the first fraction of the first feed air quantity compressed to the fourth pressure level in the first booster is supplied to the first decompression turbine, which is used to drive the first booster, and decompressing the second fraction or the first portion of the first fraction of the first feed air quantity to the first pressure level in the first decompression turbine, and supplying the further portion of the first fraction of the first feed air quantity compressed to the fourth pressure level in the first booster to the second booster and compressing the further portion to the fifth pressure level in the second booster, and wherein the first fraction of the feed air quantity is at the temperature level of −100 to −60° C. at the outlet of the first booster, wherein the further portion of the first fraction of the feed air quantity is heated to the temperature level of −20 to 40° C. prior to being compressed in the second booster, and wherein air at the third or at the fourth pressure level is supplied to a second decompression turbine, which is used to drive the second booster, and is decompressed to the second pressure level in the second decompression turbine, wherein the air supplied to the second decompression turbine is formed by an another portion of the first fraction of the feed air quantity compressed to the fourth pressure level in the first booster, or is formed by a third fraction of the feed air quantity at the third pressure level.

* * * * *